US011852313B2

(12) United States Patent
Gloss et al.

(10) Patent No.: US 11,852,313 B2
(45) Date of Patent: Dec. 26, 2023

(54) LIGHT DEVICE OF A VEHICLE TO ENSURE A DARK, OR COLORED APPEARANCE OF AT LEAST A PART OF THE LIGHT DEVICE IN THE OFF STATE

(71) Applicant: PO Lighting Czech s.r.o., Senov U Noveho Jicina (CZ)

(72) Inventors: Tomas Gloss, Vitkov (CZ); Jakub Hruska, Hlucin (CZ); Jiri Kochanek, Frydek-Mistek (CZ)

(73) Assignee: PO Lighting Czech s.r.o., Senov u Noveho (CZ)

( * ) Notice: Subject to any disclaimer, the term of this patent is extended or adjusted under 35 U.S.C. 154(b) by 0 days.

(21) Appl. No.: 17/688,991

(22) Filed: Mar. 8, 2022

(65) Prior Publication Data

US 2022/0290834 A1 Sep. 15, 2022

(30) Foreign Application Priority Data

Mar. 10, 2021 (CZ) ..... CZ2021-112

(51) Int. Cl.
*F21S 41/43* (2018.01)
*F21S 45/50* (2018.01)
*F21S 41/141* (2018.01)

(52) U.S. Cl.
CPC ..... *F21S 41/43* (2018.01); *F21S 41/141* (2018.01); *F21S 45/50* (2018.01)

(58) Field of Classification Search
CPC ..... F21S 41/43; F21S 41/141; F21S 45/50; F21S 43/255; F21S 43/40; F21S 43/50;
(Continued)

(56) References Cited

U.S. PATENT DOCUMENTS 1,517,661 A * 12/1924 Wilson ..... F21V 11/00 362/354
1,541,706 A * 6/1925 Hamburg ..... F21S 41/43 362/337

(Continued)

FOREIGN PATENT DOCUMENTS

CZ 2016745 A3 6/2018
EP 0040853 A1 * 12/1981

(Continued)

OTHER PUBLICATIONS

Search Report dated Aug. 26, 2021, from Corresponding Czech Patent Application No. PV 2021-112 (3 pages).

*Primary Examiner* — Erin Kryukova
(74) *Attorney, Agent, or Firm* — HOVEY WILLIAMS LLP; Paul J. Walker

(57) ABSTRACT

The light device of a vehicle comprises a housing (5), covered with a translucent cover (1), a light unit (4) arranged in the housing (5) comprising at least one light source, and a functional plate member (12) comprising a lamella layer (6) configured to bind light rays (10) exiting from the optical unit (4). The lamella layer (6) comprises the first lamellas (6*a*), which are transparent for light, and the second lamellas (6*b*), which are non-transparent for light, and extend across the thickness of the lamella layer (6), are in a mutual contact and alternate with each other. The first lamellas (6*a*) are arranged for the passage of light rays (10) and the second lamellas (6*b*) are configured in such a way, when the light source is off, not to reflect the daylight (DS) that falls onto the second lamellas (6*b*) from the said external environment out of the light device into the external environment.

14 Claims, 12 Drawing Sheets

Figure 1:
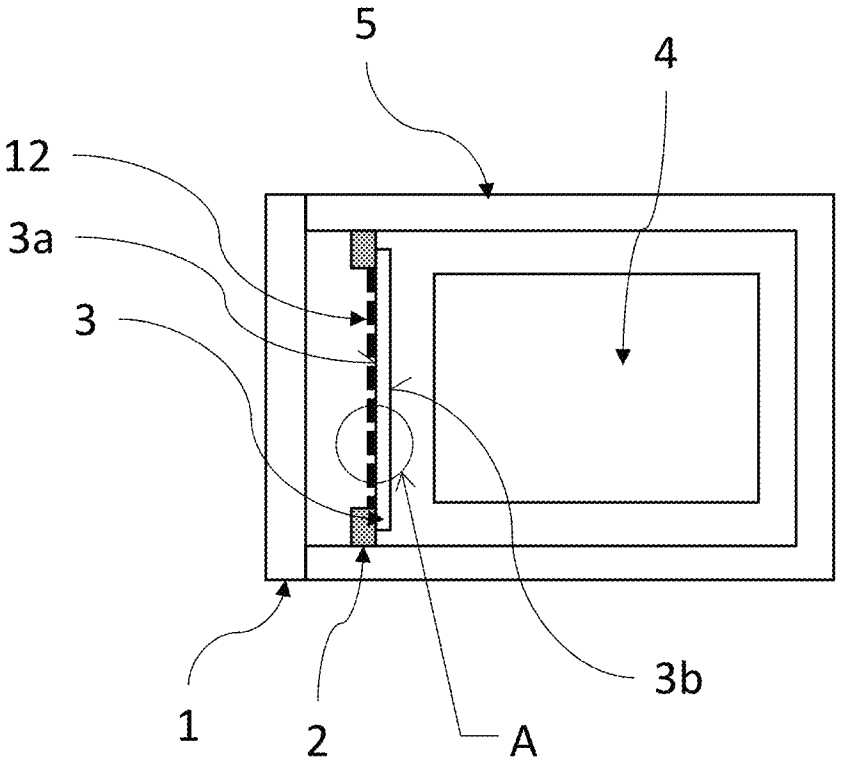

(58) Field of Classification Search
CPC .. F21S 43/26; F21S 43/20; F21S 41/20; F21S 41/40; F21V 11/02; F21V 11/04; F21V 11/06; F21V 11/065; F21V 11/12
See application file for complete search history.

(56) References Cited

U.S. PATENT DOCUMENTS

| | | | | | |
|---|---|---|---|---|---|
| 1,550,600 | A | * | 8/1925 | Wilkie | F21S 41/675 362/325 |
| 4,807,094 | A | * | 2/1989 | Mateos | F21S 41/55 362/342 |
| 5,251,110 | A | | 10/1993 | Leleve | |

FOREIGN PATENT DOCUMENTS

| | | | | |
|---|---|---|---|---|
| FR | 2487041 | A1 | * | 1/1982 |
| FR | 2487041 | A1 | | 1/1982 |
| FR | 2501336 | A1 | * | 9/1982 |
| WO | 8902638 | A1 | | 3/1989 |
| WO | 2016025982 | A1 | | 2/2016 |
| WO | 2020060534 | A1 | | 3/2020 |

* cited by examiner

LIGHT DEVICE OF A VEHICLE TO ENSURE A DARK, OR COLORED APPEARANCE OF AT LEAST A PART OF THE LIGHT DEVICE IN THE OFF STATE

RELATED APPLICATION

This application claims the priority benefit of Czech Patent Application Serial No. PV 2021-112 entitled "A light device of a vehicle to ensure a dark, or colored appearance of at least a part of the light device in the off state," filed Mar. 10, 2021, the entire disclosure of which is incorporated herein by reference

TECHNICAL FIELD

The invention relates to a light device of a vehicle to ensure, in a view of the light device from the outside of the vehicle, a dark, or colored appearance of at least a part of the light device in the off state.

BACKGROUND INFORMATION

From the document U.S. Ser. No. 10/156,337B2, a solution is known wherein the object is to achieve a dark appearance of a lamp. This effect is achieved through a combination of a semipermeable layer and a partly transparent element. This combination meets the requirement for a dark appearance, but it affects the resulting efficiency, and thus the consumption and price of such a solution, in a very significant manner.

The document EP3756046A1 discloses the use of a lamella layer, which in combination with an LCD screen provides privacy for an intended observer of the screen by purposefully limiting observability for another people from large angles. However, this type of limitation is undesired in automotive lighting, especially in the horizontal direction, where the requirement for visibility of the vehicle must be met.

It is the object of the invention to disclose a new solution of a "dark" appearance of a light function, or lamp or headlight in the off state that will as little as possible restrict (angularly) and dampen (regarding intensity) the light exiting from the light system when its function is activated.

SUMMARY OF THE INVENTION

The above-mentioned objects of the invention are fulfilled by a light device of a vehicle according to the invention, comprising a housing covered with a translucent cover, separating the external environment of the vehicle from the interior of the housing and protecting the interior of the housing from the ingress of dirt and water from the external environment, an optical unit arranged in the housing, comprising at least one light source and optical elements to direct light rays generated by the light source, and a functional plate member comprising a lamella layer. The lamella layer comprises an input surface averted from the housing and facing the optical unit and configured to bind at least a part of light rays exiting from the optical unit to the lamella layer, and an output surface facing the housing for the exit of light rays from the lamella layer. The lamella layer comprises the first lamellas, which are transparent for light, and the second lamellas, which are non-transparent for light, wherein the first and second lamellas extend from the input surface to the output surface and are in a mutual contact and alternate with each other. The first lamellas are arranged to enable passage of light rays, entering the first lamellas through the input surface, through the first lamellas, and to enable exit of these rays from the first lamellas through the output surface to fulfill the lighting function of the light device, and the second lamellas are configured, with the light source off, not to reflect the daylight, which falls onto the second lamellas from the said external environment, out of the light device to the external environment.

In another one of preferred embodiments, the functional plate member further comprises a covering layer bearing on the input surface and/or the output surface of the lamella layer and configured to reinforce and cover the lamella layer.

In another preferred embodiment, the functional plate member is the lamella layer.

In one of preferred embodiments, the second lamellas are configured to absorb at least a part of the said daylight.

In another preferred embodiment, the second lamellas are configured to reflect at least a part of the daylight in the direction from the cover and towards the optical unit.

The second lamellas are preferably of a dark color.

The first lamellas and the second lamellas preferably have the same direction.

In another preferred embodiment, the light device further comprises an optical filter having the shape of a layer parallel to the functional plate member, adapted to homogenize and/or direct light rays passing through the filter.

In another preferred embodiment, the layer of the optical filter, is connected to the surface of the functional plate member with its surface, or the optical filter and the plate member are offset from each other, the optical filter being situated between the plate member and the cover, or between the plate member and the optical unit. The surfaces of the optical filter and the functional plate member may be connected directly or by means of a layer of an optically clear adhesive.

In another preferred embodiment, the functional plate member is attached to the inner surface of the cover with its surface.

In another preferred embodiment, the light device further comprises a covering frame intended to cover those parts of the light device that should not be desirably visible from the outside of the light device.

The functional plate member and/or the layer of the optical filter are preferably attached to the frame at their edges.

In another preferred embodiment, the optical unit comprises an assembly of indirect reflectors having associated LED sources arranged on a printed-circuit board whose surface, which is reflected by the reflectors when the light device is off, is black or designed with another desired color.

CLARIFICATION OF DRAWINGS

Figure 2:
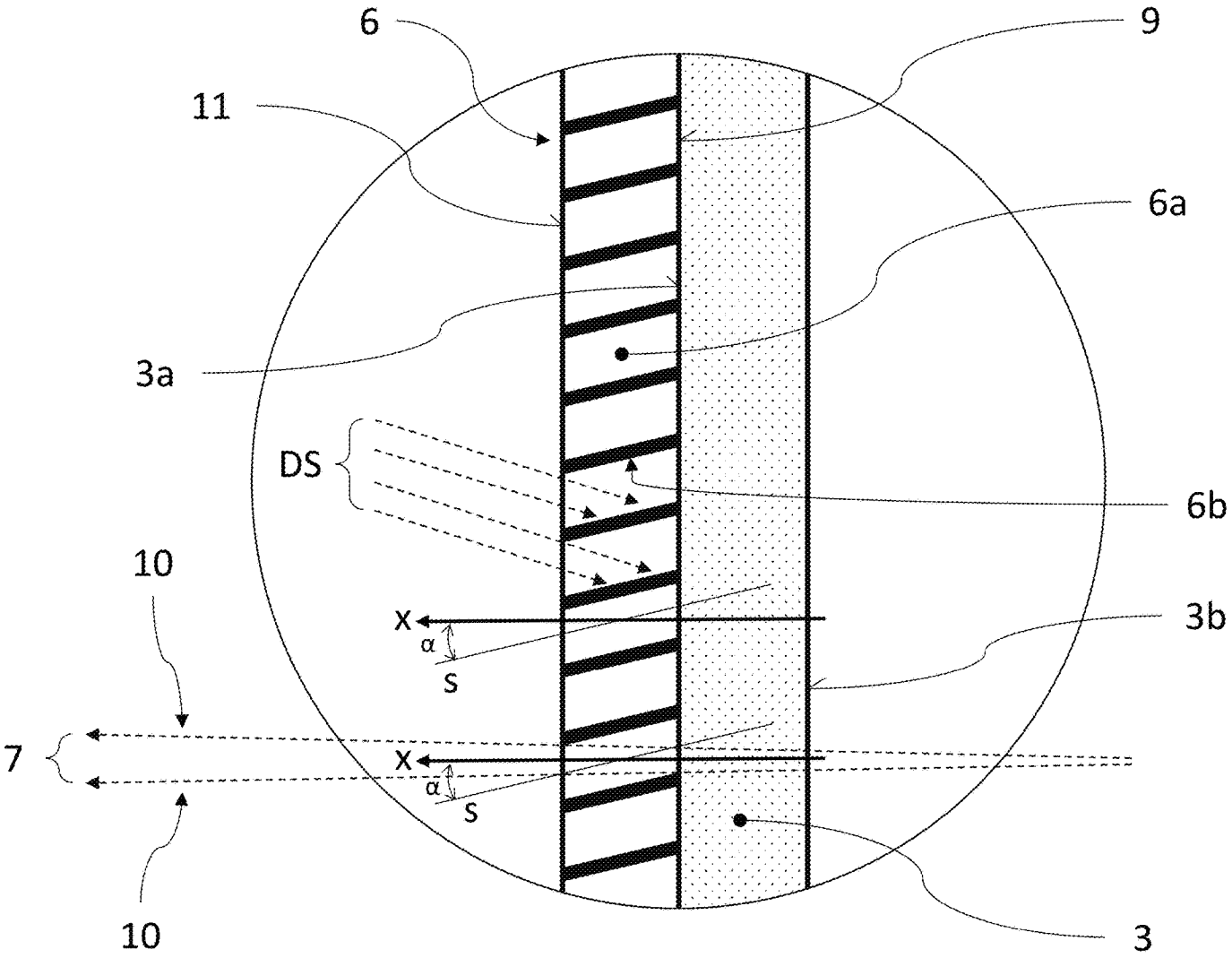
Figure 3:
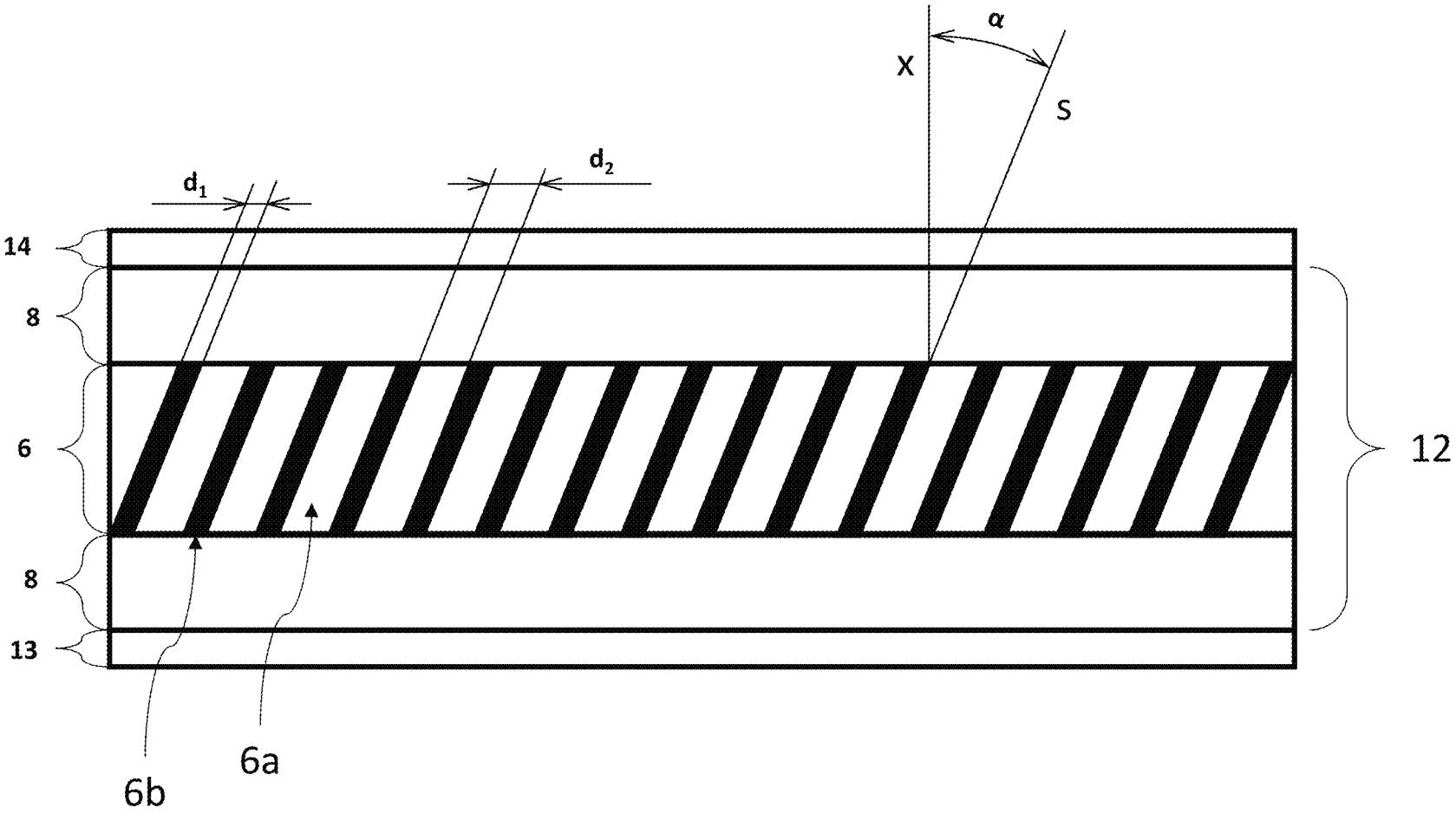
Figure 4:
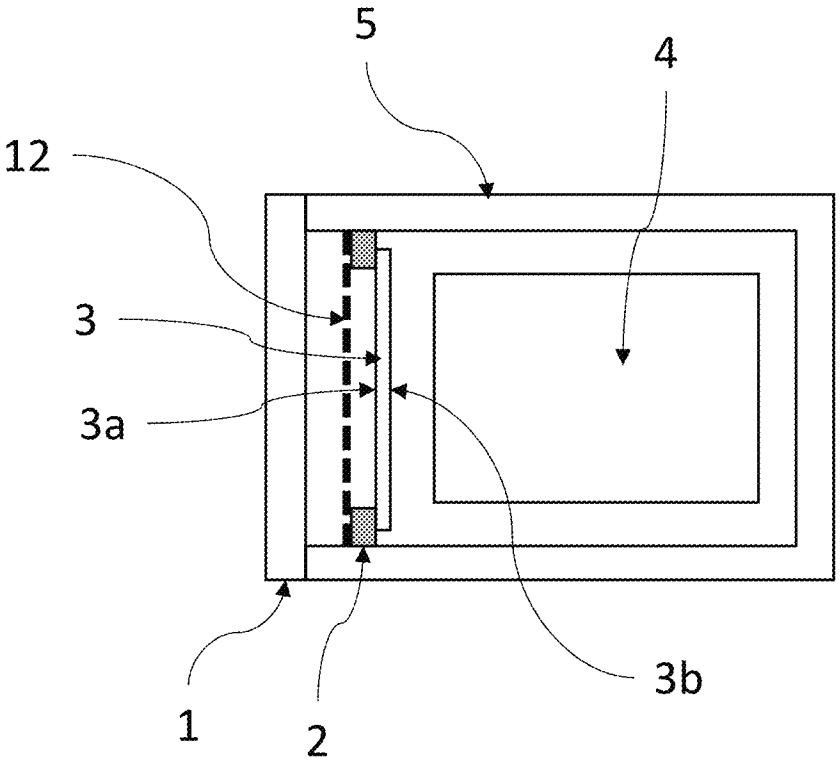
Figure 5:
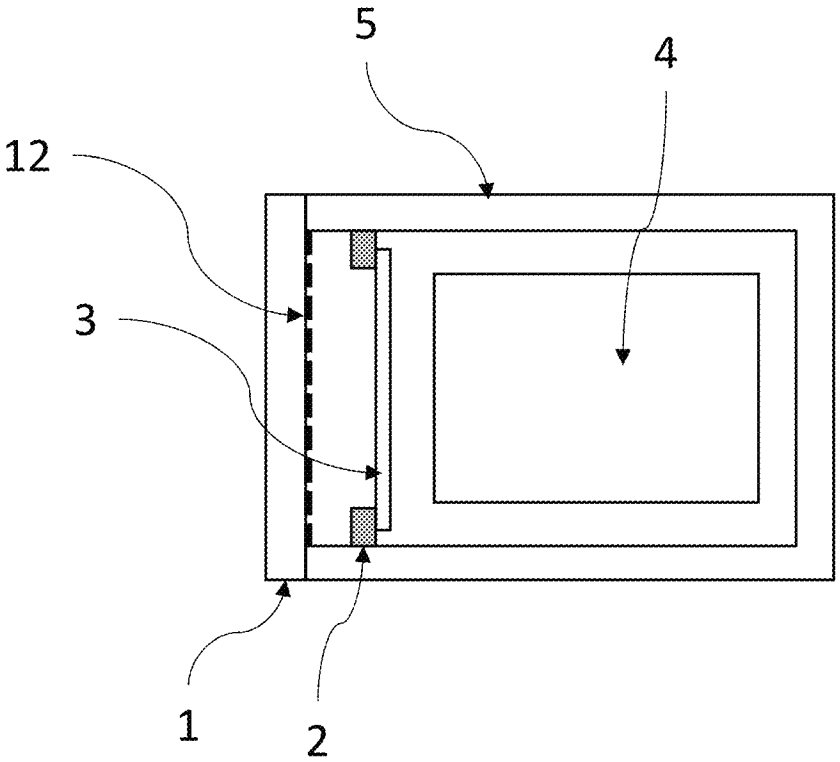
Figure 6:
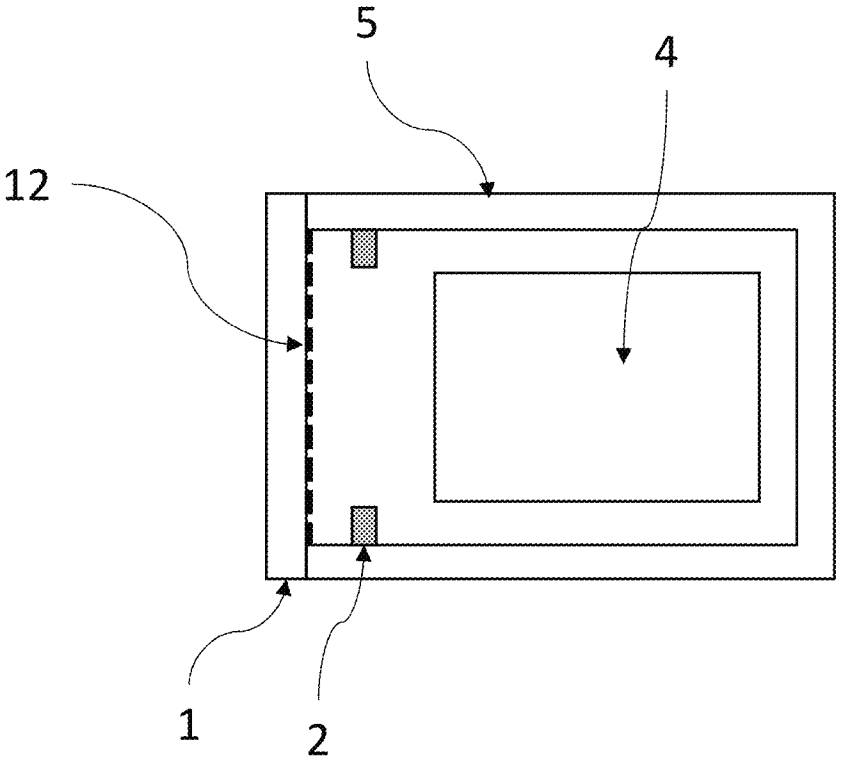
Figure 7:
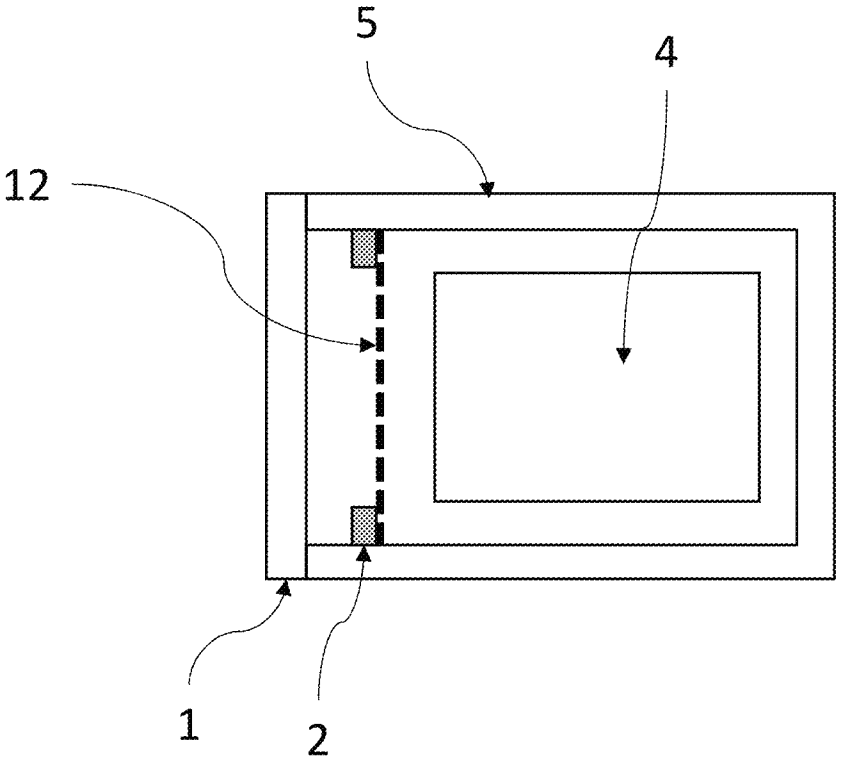
Figure 8:
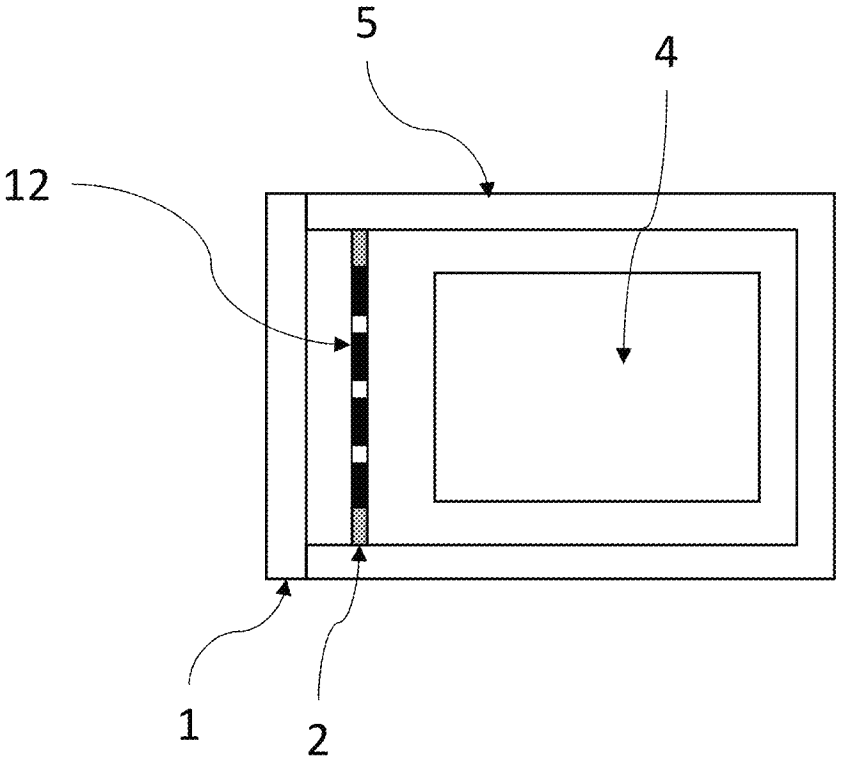
Figure 9:
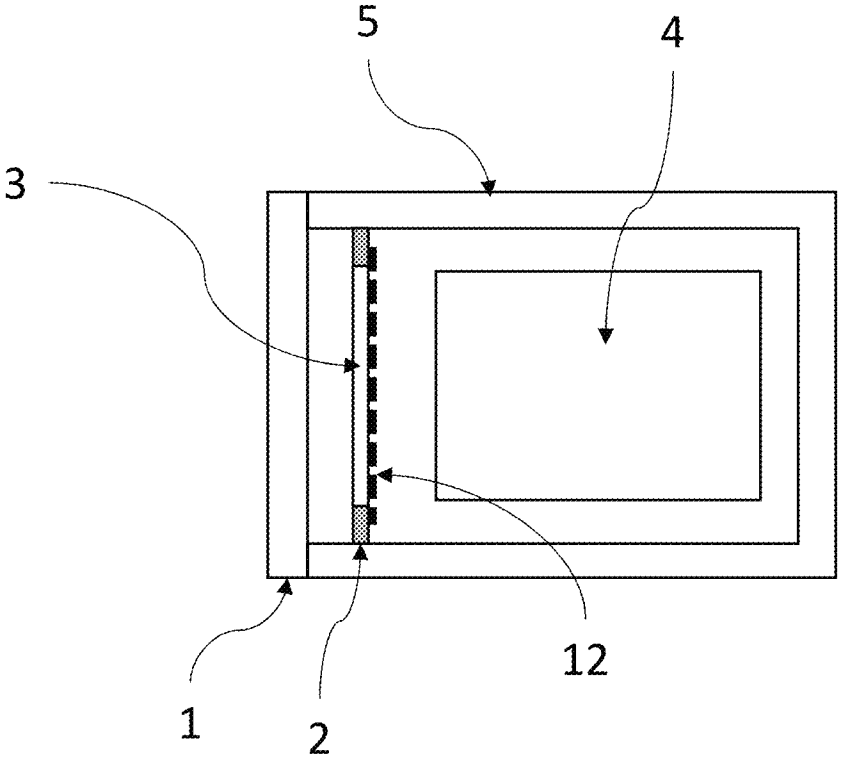
Figure 10:
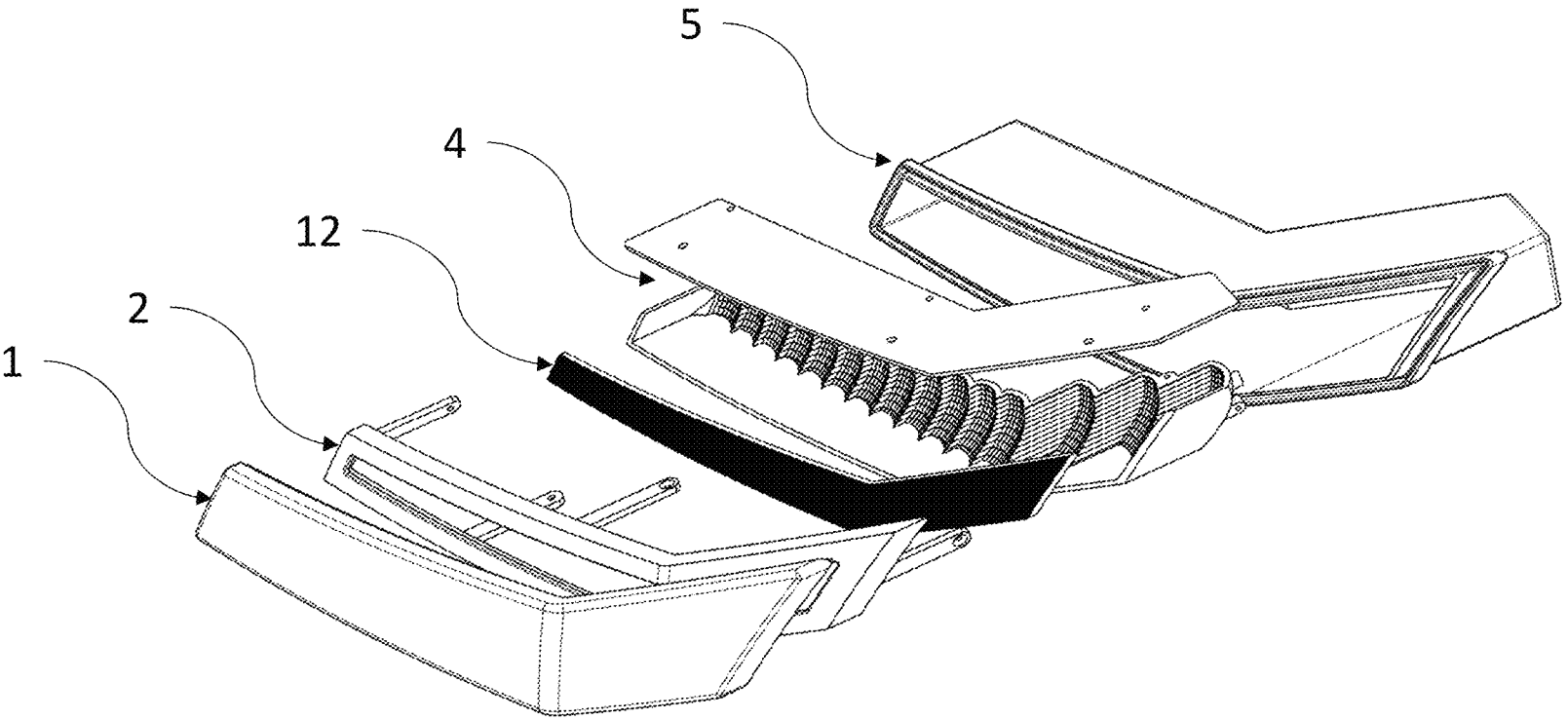
Figure 11:
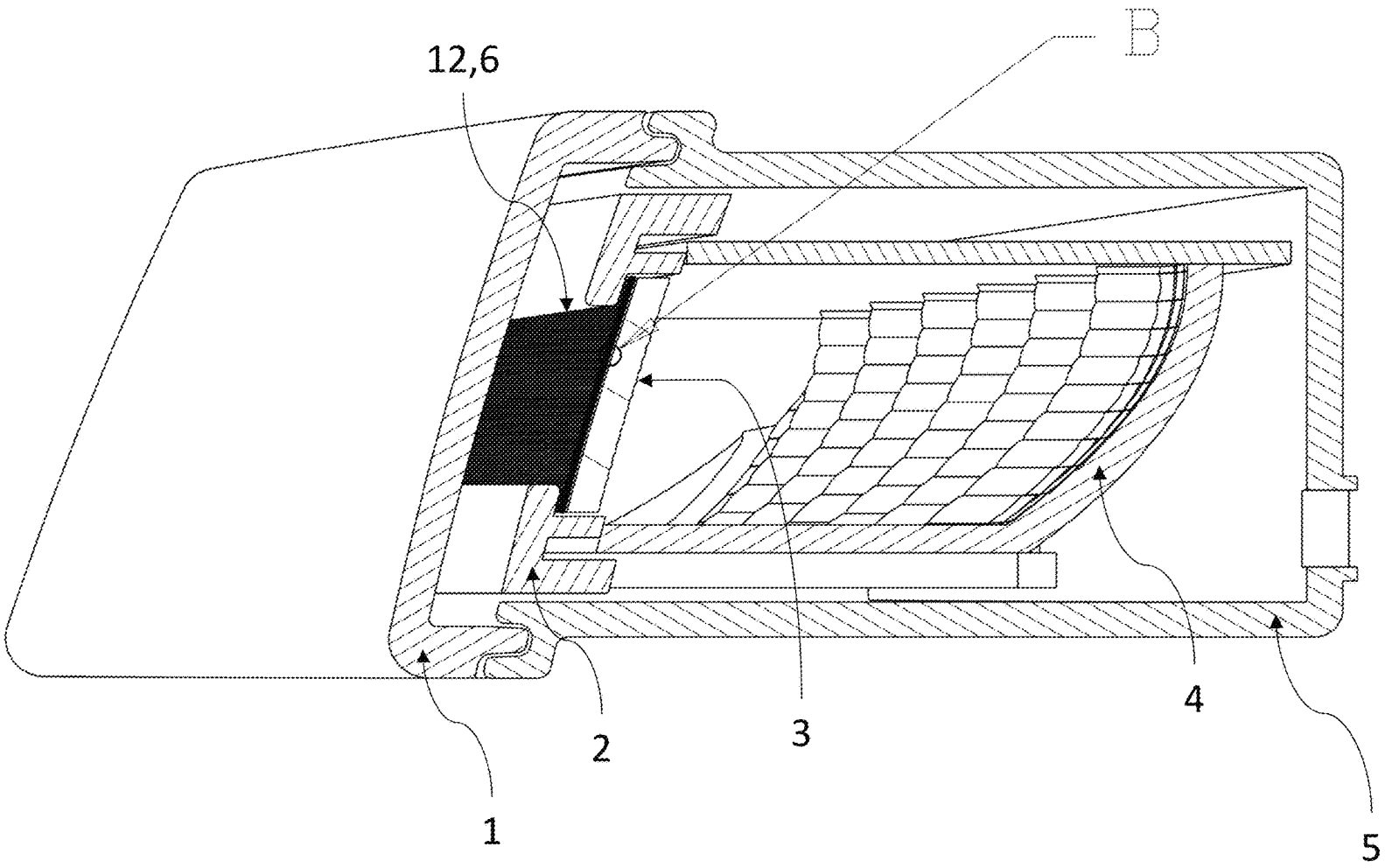
Figure 12:
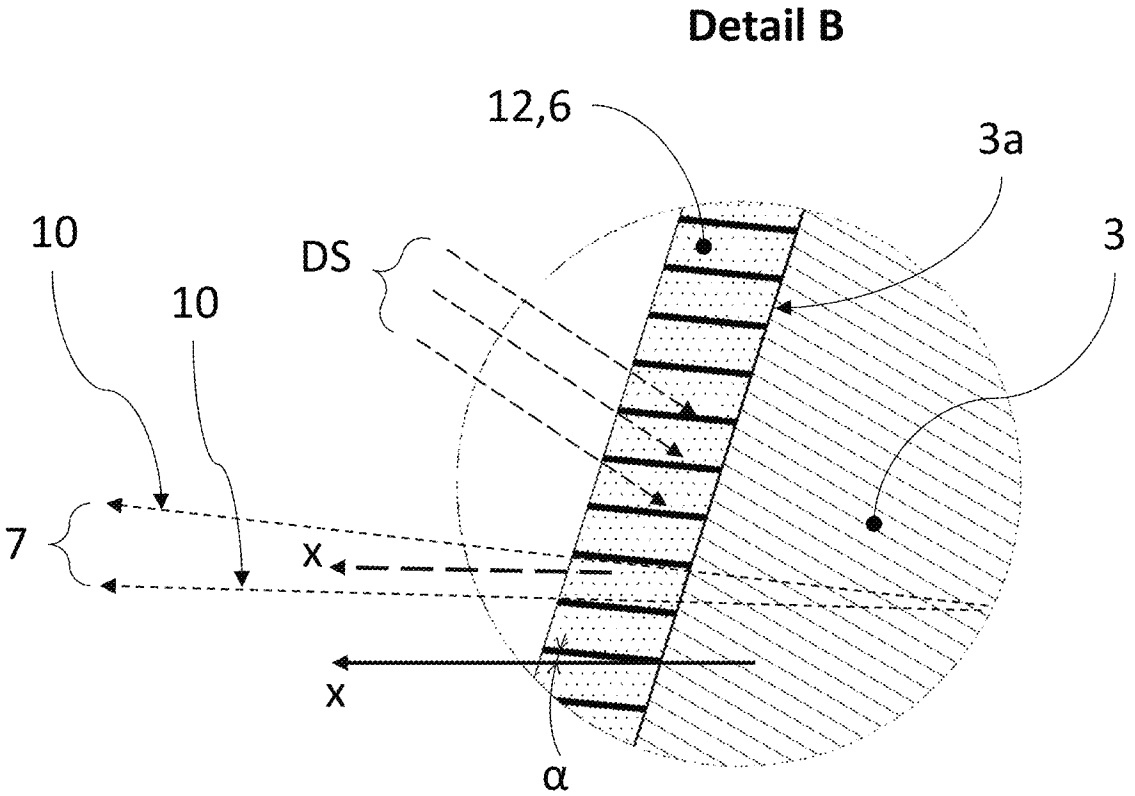

The present invention will be clarified in more detail by means of its embodiment examples with reference to the attached drawings wherein:

FIG. 1 schematically shows the first embodiment example of the inventive light device of a vehicle in a vertical sectional view, FIG. 2 shows detail A of FIG. 1, schematically illustrating the principle of the functional plate member in the light device of FIG. 1, FIG. 3 shows a cross-sectional view of an embodiment example of the functional plate member, FIG. 4 schematically shows the second embodiment example of the inventive light device of a vehicle in a vertical sectional view, FIG. 5 schematically shows the third embodiment example of the inventive light device of a vehicle in a vertical sectional view, FIG. 6 schematically shows the fourth embodiment example of the inventive light device of a vehicle in a vertical sectional view, FIG. 7 schematically shows the fifth embodiment example of the inventive light device of a vehicle in a vertical sectional view, FIG. 8 schematically shows the sixth embodiment example of the inventive light device of a vehicle in a vertical sectional view, FIG. 9 schematically shows the seventh embodiment example of the inventive light device of a vehicle in a vertical sectional view, FIG. 10 shows an exploded view of individual parts of an embodiment example of the inventive light device, and FIG. 11 schematically shows the light device of FIG. 10 in the assembled condition in a vertical sectional view, and FIG. 12 shows detail B of FIG. 11.

EMBODIMENT EXAMPLES OF THE INVENTION

FIG. 1 shows a vertical sectional view of the first embodiment example of the inventive light device. The light device comprises a carrier housing 5, a transparent or translucent cover 1 covering the housing 5 to protect its interior/contents from dirt, water, snow etc. from the external environment of the vehicle, which would otherwise get inside the housing 5. Thus, the outer—i.e. front surface of the cover 1 is in contact with the external environment of the vehicle. Inside the housing 5, a covering frame 2 is attached to the housing 5. An optical filter 3 is attached to the covering frame 2. The optical filter 3 is configured to homogenize light and/or direct light that was emitted to the optical filter 3 by the optical unit 4.

The optical unit 4 generally comprises at least one light source and directing elements to direct light emitted by the light source to the required direction or directions. A functional plate member 12 is attached to the front surface 3*a* of the filter 3.

FIG. 2 shows detail A of FIG. 1, which illustrates the arrangement of the functional plate member 12. In the embodiment example of FIG. 1, the plate member 12 consists of a lamella layer 6 (in other embodiments, the plate member 12 may additionally comprise a covering layer or layers as illustrated below) that comprises the first lamellas 6*a*, which are transparent for light, and the second lamellas 6*b*, which are non-transparent for light, wherein the first and second lamellas 6*a*, 6*b* extend from the input surface 9 to the output surface 11 of the lamella layer 6 and are in a mutual contact and alternate with each other. The first lamellas 6*a* are arranged to enable passage of light rays 10, entering the first lamellas 6*a* through the input surface 9, through the first lamellas 6*a*, and to enable exit of these rays 10 from the first lamellas 6*a* through the output surface 11 to fulfill the lighting function of the light device. FIG. 2 shows end light rays 10 that directly pass through the lamella 6*a*, these end rays 10 defining between each other the angular range of the output light beam 7 of all light rays 10, passing directly—i.e. without reflection—through the particular first lamella 6*a*. The light beam 7 participates in the lighting function that is fulfilled by the light device.

FIG. 2 also shows the main direction x of the light beam 7, which is approximately identical to the direction of the light beam 7 axis. The individual light beams 7 together form the main light beam of the lighting function of the light device. The main direction x is then approximately parallel to axis of the main light beam.

The second lamellas 6*b* are configured, with the light source off (the light device off), not to reflect the daylight DS that falls onto the second lamellas 6*b* from the said external environment out of the light device into the external environment. The second lamellas 6*b* preferably have a dark appearance, they may be e.g. black or colored, which consequently provides a general dark or colored appearance of the deactivated light device in a view from the outside of the part of the light device where the plate member 12 is situated. The optical filter 3 may be on its rear surface 3*b* fitted with optical elements (e.g. cushions, micro-optics, graining, etc.).

As shown in FIG. 2, the axes s representing the direction of the second lamellas 6*b* in the cross-section make an angle $\alpha$ with the main direction x of the output light beams 7. To maintain sufficient light efficiency of the lighting function and to ensure a dark or colored appearance when the light device is off, the angle $\alpha$ should generally be in the range of 0° to 30°.

FIG. 3 shows a cross-sectional view of an embodiment example of the functional plate member 12. In this embodiment example, the functional plate member 12 comprises a lamella layer 6 and covering layers 8 that the lamella layer 6 is fitted with at both the sides on its surfaces. Here, the covering layers 8 are used to reinforce and at the same time to cover the lamella layer 6. Using one or both the covering layers 8 is optional and is mainly significant in embodiments where the plate member 12 does not bear on the surface of another component of the light device with its surface, especially on the surface of the optical filter layer 3, as it is the case of e.g. the embodiments of FIGS. 4 and 7. However, depending on the production methods, e.g. if the plate member 12 is produced by means of the multicomponent injection method, even a plate member 12 exclusively consisting of the lamella layer 6 may be self-contained so that it is not necessary to use a covering layer 8. As shown in FIG. 3, the outer surface of the covering layer 8 may be fitted with a layer of optically clear adhesive 13 by means of which the plate member 12 is, depending on the particular embodiment, attached to the layer of the optical filter 3, or to the inner surface of the transparent or translucent cover 1. In certain cases, it may be suitable to use optical coating 14, which is e.g. configured as anti-reflective, UV-protective, etc. Such a production method is also possible when the lamella layer 6 is produced together with one covering layer 8, the surface of the lamella layer 6 that is not fitted with a covering layer 8 being connected to the layer of the optical filter 3, or possibly to the inner surface of the cover 1, or another optical member of the light device system within the reinjection process.

Below, examples of preferred thickness ranges of individual layers are presented, the resulting configuration being always adapted to the particular design for the particular lighting function of the light device:

thickness of the lamella layer 6: 200 μm-5000 μm
thickness of the covering layer 8: 50 μm-1000 μm
thickness of the optically clear adhesive: 25 μm-1000 μm
thickness of the optical coating 14: 5 nm-100 μm Besides the thicknesses of individual layers, the thicknesses and angle of the first and second lamellas 6*a*, 6*b*, forming the lamella layer 6, can also be configured. The first and second lamellas 6*a*, 6*b* can be tilted by the angle $\alpha$ with respect to the main direction x of the output light beam 7, namely in the range of 0° to 30°. The thickness d1 of the second lamellas 6*b* may be in the range of 6-2000 μm, and the thickness d2 of the first lamellas 6*a* within the limits of 80-2000 μm.

FIG. 4 shows a vertical sectional view of the second embodiment example of the light device, where, unlike the embodiment of FIG. 1, the functional plate member 12 is attached to the front side of the covering frame 2. Thus, the optical filter 3 may be optionally fitted with optical elements on its front surface 3*a* and/or the rear surface 3*b*. In this case, the functional plate member 12 may be a self-contained optical component, e.g. having the form of a foil. An example of a detailed arrangement of the plate member 12, which is suitable for the embodiment example illustrated in FIG. 4, is the arrangement of the plate member 12 shown in FIG. 3.

FIG. 5 shows the configuration of the third embodiment example of the light device wherein the functional plate member 12 is firmly connected to the inner surface of the transparent or translucent cover 1, e.g., by means of optically clear adhesive, e.g., in a molding process wherein the plate member 12 having the form of a foil is inserted into the injection tool and is "reinjected" by the material of the cover 1. Again, the optical filter 3 is used here to homogenize and/or direct light exiting from the optical unit 4, and is attached to the frame 2.

FIG. 6 shows the fourth embodiment example of the inventive light device, which is similar to the preceding embodiment with the difference that no optical filter 3 is used here. Thus, a light beam with the required parameters to enter the functional member 12 is produced by the optical components of the optical unit 4 alone without a separate optical filter having to be used to achieve these parameters.

FIG. 7 shows the fifth embodiment example wherein the functional plate member 12 having the form of a foil is attached directly in or to the frame 2 by means of both-sided adhesive, welding, fusion, or possibly reinjection, or by means of another mechanical connection.

FIG. 8 shows the sixth embodiment example of the inventive light device wherein the functional plate part 12 fulfills the function of an optical filter at the same time. The plate part 12 is produced in the form of a molded part and two-component molding is used to produce a lamella layer 6 consisting of the first and second lamellas 6*a*, 6*b*, arranged in the frame 2, wherein the plate part 12 may be, on its surface, optionally fitted with optical elements to diffuse or direct light. In the embodiment shown, the plate part 12 is simultaneously connected to the frame 2 by means of reinjection in a mold so that two-component or three-component molding/injection produces an integral body comprising the covering frame 2 as well as the plate part 12. However, such production methods may be considered where the plate part 12 is connected to the covering frame 2 in another way as well (gluing, welding, screwing, clipping, etc.).

FIG. 9 shows the seventh embodiment example of the inventive light device wherein the optical filter 3 is connected to the covering frame 2 as a single part by means of multiple molding, and the functional plate part 12 is connected e.g. by means of optically clear adhesive to the rear surface 3*b* of the optical filter 3. Thus, the optical filter 3 may be fitted with optical elements on its front surface 3*a*.

FIG. 10 shows, in an exploded view, individual components of an embodiment example of the light device—lamp according to the invention. This embodiment comprises a housing 5, an optical unit 4 comprising an assembly of indirect reflectors associated with LED sources that are arranged on a printed-circuit board. If in the off state of the lamp a black appearance is required, the printed-circuit board preferably has a dark, or directly black color, because a reflection of the printed-circuit board is visible on the reflector surfaces, which will produce an even darker or blacker appearance with the lamp off without affecting the lighting function the lamp fulfills in the activated (on) state. Within the light device, a covering frame 2 may optionally be further used to cover the components that should not be visible in a view of the light device from the outside of the vehicle in which body the light device is installed. Therefore, the covering frame 2 mainly fulfills the aesthetic or designer function. An optical filter 3 is inserted in the frame 2 and possibly firmly connected to the frame 2, the functional plate member 12 being attached to the front surface 3*a* of the optical filter by means of optically clear adhesive. The covering frame 2 is further connected to the housing 5, which is covered by and connected to the transparent or translucent cover 1.

FIG. 11 schematically shows a vertical sectional view of the light device of FIG. 10 in the assembled condition and FIG. 12 shows detail B of FIG. 11. The passage of light rays through the optical filter 3 and the functional plate member 12 consisting of the lamella layer 6 is seen here. The functional plate member 12 is configured in such a way to transmit to the highest possible extent light rays aiming at the measuring points of the light function in the main direction x (in the space, the output light beam 7 is generally located with respect to the main direction x in the range of +/−20° for the main beam, and at the same time 45°, or 80°, respectively for geometrical visibilities), but at the same time, it is configured in such a way to maximally absorb the daylight DS coming from the external environment. In certain embodiment examples, especially with respect to the required position and orientation of the front surface 3*a* of the optical filter 3, which is prevailingly defined by the required designer intention, it is suitable to adapt the tilt of the first and second lamellas 6*a*, 6*b* in the lamella layer 6 by the given angle α. The level of transmissivity, and thus the black color of the function in the off state can be controlled by the parameters of the functional plate member 12, which were discussed above with reference to FIG. 3.

LIST OF REFERENCE SIGNS

1—cover
2—covering frame
3—optical filter
3*a*—front surface
3*b*—rear surface
4—optical unit
5—housing
6—lamella layer
6*a*—first lamella
6*b*—second lamella
7—output light beam
8—covering layer
9—input surface
10—light rays
11—output surface
12—functional plate member
13—optically clear adhesive
14—optical coating
x—main direction, i.e. approximately axis of the main light beam of the lighting function of the light device
s—direction of the lamellas
DS—daylight
α—angle
d1, d2—thickness

The invention claimed is:

1. A light device of a vehicle, comprising:

a housing covered with a transparent or translucent cover separating the external environment of the vehicle from the interior of the housing and protecting the interior of the housing from the ingress of dirt and water from the external environment, an optical unit situated in the housing, comprising at least one light source and optical elements to direct light rays generated by the light source, and a functional plate member comprising a lamella layer, wherein the lamella layer comprises first lamellas, which are transparent for light, second lamellas, which are non-transparent for light, an input surface that is averted from the cover, faces the optical unit, and is configured to bind at least a part of light rays exiting from the optical unit to the lamella layer, and an output surface, facing the cover, for the exit of light beams of light rays through the first lamellas from the lamella layer, wherein the first and second lamellas— extend across the whole thickness of the lamella layer, are in a mutual contact and alternate each other, are relative to a horizontal plane inclined so that light beams, comprising the at least part of light rays exiting from the optical unit and that pass through the lamella layer directly without reflection from the second lamellas, pass through the first lamellas, and so that, when the light source is off, the daylight that falls onto the second lamellas from the said external environment is not reflected by the second lamellas out of the light device into the external environment.

2. The light device of a vehicle according to claim 1, wherein the functional plate member further comprises a covering layer bearing on the input surface and/or the output surface of the lamella layer and configured to reinforce and cover the lamella layer.

3. The light device of a vehicle according to claim 1, wherein the functional plate member is the lamella layer.

4. The light device of a vehicle according to claim 1, wherein the second lamellas are configured to absorb at least a part of the said daylight.

5. The light device of a vehicle according to claim 1, wherein the second lamellas are configured to reflect at least a part of the daylight in the direction from the cover and towards the optical unit.

6. The light device of a vehicle according to claim 1, wherein the second lamellas are of a dark color.

7. The light device of a vehicle according to claim 1, wherein the first lamellas and the second lamellas have the same direction.

8. The light device of a vehicle according to claim 1, wherein the light device further comprises an optical filter having the shape of a layer parallel to the functional plate member, adapted to homogenize and/or direct light rays passing through the filter.

9. The light device of a vehicle according to claim 8, wherein the layer of the optical filter is connected to the surface of the functional plate member with its surface, or the optical filter and the plate member are distanced from each other, the optical filter being situated between the plate member and the cover, or between the plate member and the optical unit.

10. The light device of a vehicle according to claim 9, wherein the surfaces of the optical filter and the functional plate member are connected directly or by means of a layer of optically clear adhesive.

11. The light device of a vehicle according to claim 1, wherein the functional plate member is attached to the inner surface of the cover with its surface.

12. The light device of a vehicle according to claim 1, wherein the light device further comprises a covering frame designed to cover those parts of the light device that should not be visible from the outside of the light device.

13. The light device of a vehicle according to claim 12, wherein the functional plate member and/or the layer of the optical filter are attached to the frame at their edges.

14. The light device of a vehicle according to claim 1, wherein the optical unit comprises an assembly of indirect reflectors having associated LED sources arranged on a printed-circuit board whose surface is dark, black or designed in another desired color.

* * * * *